US008808585B2

(12) United States Patent
Pulido Sanchez et al.

(10) Patent No.: US 8,808,585 B2
(45) **Date of Patent: *Aug. 19, 2014**

(54) VEGETABLE OIL OF HIGH DIELECTRIC PURITY, METHOD FOR OBTAINING SAME AND USE IN AN ELECTRICAL DEVICE

(75) Inventors: Alberto José Pulido Sanchez, Guadalajara (MX); Carlos Manuel Urzua Hernandez, Monterrey (MX); Sergio Francisco Cazares Mendez, Guadalupe (MX); Jerónimo R. Villarreal Rios, Guadalupe (MX); José Eulalio Contreras De Leon, San Nicolás de los Garza (MX); David Apolinar Guerra Zubiaga, Monterrey (MX)

(73) Assignees: Ragasa Industrias, S.A. DE C.V., Nuevo Leon (MX); Prolec-GE Internacional, S. DE R.L. DE C.V., Nuevo Leon (MX)

( * ) Notice: Subject to any disclaimer, the term of this patent is extended or adjusted under 35 U.S.C. 154(b) by 0 days.

This patent is subject to a terminal disclaimer.

(21) Appl. No.: 13/298,004

(22) Filed: Nov. 16, 2011

(65) Prior Publication Data

US 2012/0061629 A1 Mar. 15, 2012

Related U.S. Application Data

(62) Division of application No. 13/003,179, filed as application No. PCT/MX2008/000140 on Oct. 16, 2008.

(51) Int. Cl.
*H01B 3/20* (2006.01)

(52) U.S. Cl.
USPC ..... 252/579

(58) Field of Classification Search
USPC ..... 252/579
See application file for complete search history.

(56) References Cited

U.S. PATENT DOCUMENTS

| | | | |
|---|---|---|---|
| 2,037,686 | A | 4/1936 | Clark |
| 1,935,595 | A | 11/1943 | Clark |
| 2,418,820 | A | 4/1947 | Coggins et al. |
| 2,423,413 | A | 7/1947 | Soday |
| 4,019,996 | A | 4/1977 | Jay et al. |
| 4,082,866 | A | 4/1978 | Link |
| 4,196,408 | A | 4/1980 | Link |
| 4,206,066 | A | 6/1980 | Rinehart |
| 4,388,669 | A | 6/1983 | Cichanowski |
| 4,521,826 | A | 6/1985 | Shedigian et al. |
| 4,536,331 | A | 8/1985 | Shedigian |
| 4,543,207 | A | 9/1985 | Sato et al. |
| 4,609,969 | A | 9/1986 | Shedigian |
| 4,621,302 | A | 11/1986 | Sato et al. |
| 4,679,119 | A | 7/1987 | Shedigian |
| 4,983,222 | A | 1/1991 | Green et al. |
| 5,017,733 | A | 5/1991 | Sato et al. |
| 5,077,069 | A | 12/1991 | Chang et al. |
| 5,241,092 | A | 8/1993 | Cheng et al. |
| 5,250,750 | A | 10/1993 | Shubkin et al. |
| 5,296,155 | A | 3/1994 | Reitz |
| 5,336,847 | A | 8/1994 | Nakagami |
| 5,516,923 | A | 5/1996 | Hebert et al. |
| 5,708,558 | A | 1/1998 | Dequasie |
| 5,766,517 | A | 6/1998 | Goedde et al. |
| 5,795,969 | A | 8/1998 | Fehr et al. |
| 5,840,945 | A | 11/1998 | Tsujiwaka et al. |
| 5,840,946 | A | 11/1998 | Wong et al. |
| 5,872,271 | A | 2/1999 | Cole et al. |
| 5,912,215 | A | 6/1999 | Sapienza et al. |
| 5,949,017 | A | 9/1999 | Oommen et al. |
| 5,958,851 | A | 9/1999 | Cannon et al. |
| 5,969,169 | A | 10/1999 | Fan |
| 5,981,781 | A | 11/1999 | Knowlton |
| 6,033,706 | A | 3/2000 | Silkeberg et al. |
| 6,037,537 | A | 3/2000 | McShane et al. |
| 6,065,572 | A | 5/2000 | Schober et al. |
| 6,103,918 | A | 8/2000 | Dahlen |
| 6,127,326 | A | 10/2000 | Dieckmann et al. |
| 6,137,674 | A | 10/2000 | Jedlitschka |
| 6,159,913 | A | 12/2000 | Cannon et al. |

(Continued)

FOREIGN PATENT DOCUMENTS

| | | |
|---|---|---|
| CA | 2204273 | 11/1998 |
| EP | 1161877 | 12/2001 |

(Continued)

OTHER PUBLICATIONS

P. Boss et al., "New Insulating Fluids for Transformers Based on Biodegradable High Oleic Vegetable Oil and Ester Fluid"The Institute of Electrical Engineers, 1999, pp. 1-10, IEEE, Xplore, London.

(Continued)

*Primary Examiner* — Nicole M Buie-Hatcher
*Assistant Examiner* — M. Reza Asdjodi
(74) *Attorney, Agent, or Firm* — Kilpatrick Townsend & Stockton LLP

(57) ABSTRACT

A dielectric high purity vegetable oil—free from antioxidants and/or external additives to be used in electric equipment such as transformers, as isolating element and as cooling means and a method for obtaining the same in which the dielectric high purity vegetable oil—is obtained by means of the optimization of the bleaching steps—and deodorizing—from the Refining process—known as Modified Caustic Refining Long-Mix (RBD).

25 Claims, 2 Drawing Sheets

(56) References Cited

U.S. PATENT DOCUMENTS

| | | | | |
|---|---|---|---|---|
| 6,177,031 | B1 | 1/2001 | Minnick et al. | |
| 6,184,459 | B1 | 2/2001 | McShane et al. | |
| 6,207,626 | B1 | 3/2001 | Cannon et al. | |
| 6,229,033 | B1 | 5/2001 | Knowlton | |
| 6,245,726 | B1 | 6/2001 | Cannon et al. | |
| 6,248,910 | B1 | 6/2001 | Franke | |
| 6,251,460 | B1 | 6/2001 | Ganguli et al. | |
| 6,274,067 | B1 | 8/2001 | Oommen et al. | |
| 6,280,659 | B1 | 8/2001 | Sundin | |
| 6,312,623 | B1 | 11/2001 | Oommen et al. | |
| 6,316,542 | B1 | 11/2001 | Berger et al. | |
| 6,340,658 | B1 * | 1/2002 | Cannon et al. | 508/491 |
| 6,347,033 | B1 | 2/2002 | Minnick et al. | |
| 6,348,610 | B1 | 2/2002 | Martinez Force et al. | |
| 6,352,655 | B1 * | 3/2002 | McShane et al. | 252/579 |
| 6,384,252 | B1 | 5/2002 | Pageat | |
| 6,398,986 | B1 * | 6/2002 | McShane et al. | 252/579 |
| 6,423,857 | B1 | 7/2002 | Copeland et al. | |
| 6,448,423 | B1 | 9/2002 | Hernandez et al. | |
| 6,485,659 | B1 * | 11/2002 | Goedde et al. | 252/570 |
| 6,486,336 | B1 | 11/2002 | Osorio et al. | |
| 6,511,690 | B1 | 1/2003 | Tysinger et al. | |
| 6,613,250 | B2 | 9/2003 | McShane et al. | |
| 6,645,404 | B2 | 11/2003 | Oommen et al. | |
| 6,680,396 | B2 | 1/2004 | DeBonte et al. | |
| 6,706,299 | B2 | 3/2004 | Thengumpillil et al. | |
| 6,710,196 | B2 | 3/2004 | Ushioda et al. | |
| 6,713,117 | B1 | 3/2004 | Kodali | |
| 6,726,857 | B2 * | 4/2004 | Goedde et al. | 252/570 |
| 6,905,638 | B2 | 6/2005 | Corkran et al. | |
| 6,906,211 | B2 | 6/2005 | Tysinger et al. | |
| 6,994,882 | B2 | 2/2006 | Kodali | |
| 7,048,875 | B2 | 5/2006 | Oommen et al. | |
| 7,112,688 | B1 | 9/2006 | Tysinger et al. | |
| 7,417,159 | B2 | 8/2008 | Galvez et al. | |
| 7,459,574 | B2 | 12/2008 | Richard-Eisner et al. | |
| 7,498,455 | B2 | 3/2009 | Dehesh et al. | |
| 7,524,440 | B2 | 4/2009 | Rapp et al. | |
| 7,651,641 | B2 | 1/2010 | Corkran et al. | |
| 7,795,193 | B2 * | 9/2010 | Takei et al. | 508/485 |
| 7,902,388 | B2 * | 3/2011 | Heise et al. | 554/224 |
| 8,057,835 | B2 * | 11/2011 | Makadia et al. | 426/601 |
| 2002/0049145 | A1 * | 4/2002 | Cannon et al. | 508/491 |
| 2002/0115875 | A1 * | 8/2002 | Kaimal et al. | 554/174 |
| 2004/0185157 | A1 | 9/2004 | Kuno et al. | |
| 2004/0210070 | A1 | 10/2004 | Kruidenberg | |
| 2004/0248746 | A1 | 12/2004 | Matsui | |
| 2005/0040375 | A1 | 2/2005 | Corkran et al. | |
| 2005/0069614 | A1 | 3/2005 | Tysinger | |
| 2006/0030499 | A1 * | 2/2006 | Oommen et al. | 508/491 |
| 2006/0111578 | A1 | 5/2006 | Arhancet et al. | |
| 2008/0058578 | A1 * | 3/2008 | Zschau et al. | 588/318 |
| 2008/0214805 | A1 | 9/2008 | Misbah et al. | |
| 2008/0283803 | A1 | 11/2008 | Rapp et al. | |
| 2009/0140830 | A1 * | 6/2009 | Amanullah et al. | 336/94 |
| 2009/0270644 | A1 | 10/2009 | Kano et al. | |
| 2010/0065792 | A1 * | 3/2010 | Izcara Zurro | 252/574 |

FOREIGN PATENT DOCUMENTS

| | | | |
|---|---|---|---|
| EP | 1662513 | | 5/2006 |
| GB | 430045 | | 6/1935 |
| GB | 582281 | | 11/1946 |
| GB | 609133 | | 9/1948 |
| GB | 705592 | | 3/1954 |
| WO | 0156395 | | 8/2001 |
| WO | 2004108871 | | 12/2004 |
| WO | 2005026300 | | 3/2005 |
| WO | 2007041785 | | 4/2007 |
| WO | 2008041834 | | 4/2008 |
| WO | WO 2008 096020 | * | 8/2008 |
| WO | 2008113865 | | 9/2008 |

OTHER PUBLICATIONS

S. Chakravarty et al., The Dielectric Strength of Indian Vegetable Oils, Indian Journal of Physics, Sep. 17, 1942, pp. 82-86, vol. 16 and Proceedings of the Indian Association for the Cultivation of Science, vol. 15.

M. Beyer, Comparison of the Electric and Dielectric Behaviour of Different Insulating Fluids, Schering-Institute for High Voltage Engineering and High Voltage Plants, undated, pp. 524-528, IEEE, Xplore.

H. Borsi, "Dielectric Behavior of Silicone and Ester Fluids for Use in Distribution Transformers", IEEE Transactions on Electrical Insulation, vol. 26, No. 4, Aug. 1991, pp. 755-762.

P. Thomas, et al., "Dielectric Liquid from Vegetable Origin—Indian Beech Oil", Liquid Dielectrics Laboratory Materials Technology Division, undated, pp. 507-510, Central Power Research Institute, India.

K.N. Abd-El-Nour, "Dielectric Properties of Some Insulating Liquids", Journal of Polymer Science: Polymer Letters Edition, 1983, pp. 723-729, vol. 21, John Wiley & Sons, Inc.

Dr. B. Pahlavanpour et al., "Environmentally Friendly Insulating Oil", National Grid Company PLC, The 1999, pp. 1-5, The Institution of Electrical Engineers, London.

David Sundin, Ph.D., et al., "Fluid Choices in Retrofilling PCB Transformers," Jun. 7-10, 1992, pp. 445-447, IEEE International Symposium on Electrical Insulation, Baltimore, Maryland.

K. Dumke, et al., "Fundamental Investigations on the Influence of Temperature and Water Content on the Electrical Behavior of Fluid Impregnated Insulating Papers", IEEE International Symposium on Electrical Insulation, Jun. 16-19, 1996, pp. 542-545.

K.M. Kamath, "Variation of Dielectric Properties of Some Vegetable Oils in the Liquid-Solid Transition Phase", Indian Journal of Technology, Aug. 1971, vol. 9, No. 8.

Frank M. Clark, "Insulating Materials for Design and Engineering Practice", John Wiley & Sons, Inc., 1962, pp. 210-218.

Dr. K M Kamath, "Vegetable Oils for Electrical Use—Processing and Application", IE Journal, Dec. 5, 1973, pp. 64-70.

H.C. Keshavamurthy, et al., "Rape Seed Oil Derivative as a new Capacitor Impregnant", IEEE International Symposium on Electrical Insulation, Jun. 5-8, 1994, pp. 418-421.

Nestor B. Knoepfler, et al., "Review of Chemistry and Research Potential of *Simmondsia chinensis* (Jojoba) Oil", Agricultural and Food Chemistry, Feb. 1958, vol. 6, No. 2, pp. 118-121.

P.R. Krishnamoorthy, et al., "Effect of Antioxidants and Metal Deactivator on the Oxidation of Transformer Oil", IEEE Transactions on Electrical Insulation, Apr. 1992, vol. 27, No. 2, pp. 271-277.

I. Moumine, et al., "Vegetable Oil as an Impregnant in HV AC Capacitors", IEEE 5$^{th}$ International Conferernce on Conduction and Breakdown in Solid Dielectrics, 1995, pp. 611-615.

R.N. Mukherjea, "Dielectric Properties of Some Vegetable Oils in the Radio Frequency Region", Indian Journal of Pure & Applied Physics, Jan. 1970, pp. 176-177, vol. 8, No. 1, The Council of Scientific & Industrial Research, New Delhi.

H.C. Keshavamurthy, "Novel Capacitor Fluid from Vegetable Oil", IEEE International Symposium on Electrical Insulation, Jun. 7-10, 1998, pp. 452-455.

T.S. Ramu, "On the High Frequency Dielectric Behavior of Castor Oil", IEEE Trans. Electr. Insul, Jun. 1979, pp. 136-141, vol. EI-14, No. 3.

T.V. Oommen, "Biodegradable Electrical Insulation Fluids", IEEE Xplore, undated, pp. 465-468.

T.V. Oommen, "Introduction of a New Fully Biodegradable Dielectric Fluid", IEEE Xplore, 1998, pp. 1-4.

G.R. Paranjpe, "Dielectric Properties of Some Vegetable Oils", The indian Academy of Sciences, Jul. 1934, pp. 880-886, vol. 1, No. 1.

H. Borsi, et al., "Relation Between Faults and Generated Gases in Transformer Liquids", Proceedings of 13$^{th}$ International Conference on Dielectric Liquids, Jul. 20-25, 1999, pp. 487-490.

J.H. Torrai, et al., "Restoration of Dielectric Propertiies in Insulating Liquids After an Electrical Arc", Proceedings of 13$^{th}$ International Conference on Dielectric Liquids, Jul. 20-25, 1999, pp. 227-230.

(56) References Cited

OTHER PUBLICATIONS

S. Sankaralingam, "New Dielectric Liquids from Vegetable Origin-A Feasibility Study on Indian Rape Seed Oil", Symposium (International Conference on Large High Voltage Electric Systems), May 5-7, 1987, pp. 1-5, Cigre.
P. Thomas, et al., "Synthesis and Evaluation of Oleic Acid Esters as Dielectric Liquids", IEEE International Symposium on Electrical Insulation, Jun. 16-19, 1996, pp. 565-568.
David Sundin, "The Service History of Ester-Based Fluids Used in Railway Transformers", IEEE International Symposium on Electrical Insulation, Jun. 3-6, 1990, pp. 31-34.
U.S. Appl. No. 13/003,179 Non-Final Office Action dated Jan. 23, 2012.
Final Office Action in related U.S. Appl. No. 13/003,179, dated Sep. 14, 2012, 14 pages.
Non Final Office Action in related U.S. Appl. No. 13/297,879, dated Aug. 23, 2012, 14 pages.
Non Final Office Action in related U.S. Appl. No. 13/297,879, dated Sep. 24, 2013, 11 pages.
Non Final Office Action in related U.S. Appl. No. 13/003,179, dated Jun. 20, 2013, 9 pages.

* cited by examiner

VEGETABLE OIL OF HIGH DIELECTRIC PURITY, METHOD FOR OBTAINING SAME AND USE IN AN ELECTRICAL DEVICE

CROSS REFERENCE TO RELATED APPLICATIONS

This application is a divisional application of U.S. National Phase patent application Ser. No. 13/003,179 under 35 U.S.C. 371 filed May 6, 2011, which is related to and claims priority benefits from International Patent Application No. PCT/MX2008/000140 filed Oct. 16, 2008, the contents of which are incorporated herein by this reference in their entirety.

FIELD OF THE INVENTION

The present invention is related to vegetable oils and more particularly to a high purity dielectric vegetable oil which is free of antioxidants and/or external additives, and to a method for obtaining the same and its use in electric apparatuses.

BACKGROUND OF THE INVENTION

Nowadays, the electric industry uses a variety of dielectric fluids, such as, mineral oils, petroleum derivatives, silicone fluids and synthetic hydrocarbon oils used which are used in transformers, conductive cables and capacitors. Examples of such fluids are described in U.S. Pat. Nos. 4,082,866, 4,206,066, 4,621,302 5,017,733, 5,250,750, and 5,336,847.

Such fluids show good dielectric characteristics, however they have important drawbacks with regard to ecological issues. The main disadvantage of such fluids is that due to its chemical composition (high molecular weight), they are not biodegradable. In recent years, the electrical industries face the challenge of complying with new environmental and governmental regulations, which demand to the industry to offer "green" products, that is, to offer products that are environmentally friendly. Said environmentally tendency has propitiated the necessity of modifying processes and changing product compounds in order to fulfill said new regulations and be able to offer ecological products.

In order to fulfill the above referred requirements, electrical industry has concentrated their efforts in the production of several kinds of dielectric fluids from vegetable oils obtained from oilseeds. Several seeds have been tested among which are the sunflower, rapeseed, linseed, soybean, cotton, safflower, corn and olive seeds. Examples of vegetable oils used as dielectric fluids are described in the following patents GB-609133, CA-2204273, U.S. Pat. Nos. 5,766,517, 5,949,017, 5,958,851, 6,037,537, 6,159,913, 6,184,459, 6,207,626, 6,245,726, 6,274,067, 6,280,659, 6,312,623, 6,340,658, 6,347,033, 6,352,655, 6,398,986, 6,485,659, 6,645,404, 726,857, 6,905,638, and 7,048,875 and in the following patent applications US-2002049145, US-2005040375, US-2006030499, WO-2007029724, and MX-PA06002862.

The idea of using vegetable oils obtained from oilseeds as isolating and cooling means in electric apparatuses is not entirely new. In the past, said oils were not considered adequate for using them as dielectric fluids, mainly due to the low resistance to oxidation of said oils compared to synthetic dielectric fluids. The nature of the compounds present in vegetable oils cause the oxidative reaction to accelerate in the presence of oxygen propitiating the polymerization process and as a result, a degradation of the fluid properties. Furthermore, said oils have some degree of electrical conductivity, which increases as the properties of the oils are degradated by oxidation, polymerization and hydrolysis reactions. The raise in the electrical conductivity is caused by the increase of polar compounds formed by said reactions.

For example, soybean oil (Glycine max) as an isolating and cooling medium for electric apparatuses has not been extensively used due to its low stability to oxidation caused by its high content of polyunsaturated fatty acids.

On the other hand, vegetable oils for human consumption do not have the necessary dielectric properties for its use in electric equipment as isolating and cooling medium due to its content of polar compounds which are not required to be eliminated for domestic use.

It is worthy of note that vegetable oils are mainly comprised by a natural mix of triglycerols also known as triglycerides. In addition to the content of triglycerides in vegetable oils there is a further content of other compounds such as tocopherols, sterols, and sterol esters as well as other compounds and impurities such as phosphatides, free fatty acids, chlorophylles, metallic traces, oxidation compounds, etc.

The triglycerides are the result of an esterification reaction between three fatty acids and glycerin. The acyl groups or triglycerol fatty acids can be similar or different, or each distinct from the other two. The fatty acids can be saturated when they have no double bonds, mono-unsaturated when they have a double bond and poly-unsaturated when they have two or more double bonds.

At present, it has been demonstrated that by modifying some oil production processes such as hydrogenation or by incorporating some antioxidants and/or synthetic additives capable of retarding, preventing or avoiding oxidation, it can be improved the vegetable oil stability to oxidation in order to make feasible the use of vegetable oils in electric equipment. However, the addition of antioxidants and/or synthetic additives reduces the ability of the vegetable oil to biodegrade, which is not convenient.

As it was previously described, the vegetable dielectric oils that have been produced, contain antioxidant and/or synthetic compounds in order to compensate its poor stability to oxidation. Furthermore, some compounds are also incorporated in order to improve its pour point, which comprises the lower temperature at which the oil is able to flow.

The above referred vegetable oils are considered biodegradable, however, the chemical composition of the antioxidants and/or additives incorporated, affect its biodegradation characteristics.

Similarly, it is known that several of the antioxidants and/or synthetic additives used nowadays, have toxic characteristics which are hazardous for the personnel that are in contact with the product as well as for the environment in case there is a spillover of the product. Examples of some of said compounds are: butylated hydroxyanisole (BHA) and butylhydroxytoluene (BHT) among others.

Among all vegetable oil components, the tocopherols are natural oxidants which are convenient to preserve in the oil, however there are some other compounds or impurities whose content must be lowered or eliminated from the oil in order to make it feasible for industrial applications, which may be achieved by submitting the oil to a process called refinement.

The oil refinement process is capable of eliminating more compounds and impurities than when the operation parameters are changed; therefore, the oil refinement process is the best way to improve the quality of edible vegetable oil, by removing a percentage of the compounds and impurities that are the cause of its low dielectric capacity without changing the fatty acids that are esterified to glycerin.

The oil refinement limitations have been gradually overcome as said process has been studied, thanks to which it has been possible to find which compounds act as pro-oxidants and which compounds and in which quantities act as antioxidant, thanks to which it is possible to adjust the oil refinement process variables in order to obtain a product having good stability to oxidation at the lowest cost.

Many known processes for obtaining similar fluids use as raw material, RBD oils (refined, bleached and deodorized) obtained by the RBD oil refinement which are submitted to several steps in order to obtain an adequate dielectric oil that can be used as isolating and cooling medium.

For example, U.S. Pat. Nos. 5,949,017, 6,274,067, 6,312,623, 6,645,404, and 7,048,875 describe vegetable oils having a high content of oleic acid and adequate dielectric properties and methods for obtaining said vegetable oils which are adequate for being used as isolating and cooling medium. The processes described in said patents uses as raw material RBD oils and submit them to an additional purification step somewhat similar to the bleaching step, in order to lower or eliminate the polar materials from the oil, which give the oil bad dielectric properties, and add antioxidants and/or synthetic additives to the oil in order to obtain a good stability to oxidation.

In view of the above referred limitations and requirements, it is evident the necessity of providing a high purity dielectric vegetable oil without any content of antioxidants and/or external additives, having good biodegradation properties, which can be obtained by a modified RBD process and which can comply with certain necessary physic properties in order to be considered as a dielectric fluid.

By using said modified RBD process it is possible to obtain a high purity dielectric vegetable oil at a minimum cost and without drastically changing the RBD process for obtaining edible oil actually in use.

Additionally the present invention also provides an electric apparatus using said high purity dielectric vegetable oil without any content of antioxidants and/or external additives.

OBJECTIVES OF THE INVENTION

In view of the above referred limitations and requirements it is an objective of the present invention to provide a high purity dielectric vegetable oil without any content of antioxidants and/or external additives having a content of from 17.7% to 28.5% in weight of mono-unsaturated fatty acid; from 49.8% to 57.1% in weight of di-unsaturated fatty acid; from 5.5% to 9.5% in weight of tri-unsaturated fatty acid and from 12.7% to 18.7% in weight of saturated fatty acid and having the following properties: a dielectric strength of from 50 kV to 80 KV (separation of 2 mm); a dielectric constant of less than 2.6 at 25° C. and a dissipation factor of from 0.05% to 0.2% at 25° C.

It is also an objective of the present invention to provide a method for producing a high purity dielectric vegetable oil without any content of antioxidants and/or external additives based on a Long-Mix Modified Caustic Refinement process (RBD) comprising the stages of: degumming, neutralization, bleaching and deodorization, wherein the process of the present invention include further steps in the neutralization and bleaching steps or in the bleaching step or between the bleaching and deodorization step which comprise removing metal traces and remnant soaps from the refined and neutralized vegetable oil; submitting the refined, neutralized and filtered vegetable oil to a second bleaching stage; and adjusting the distillation temperature by stripping steam in the deodorization step at a maximum of 265° C. for a time of 20 minutes maximum so that the production of trans fatty acids do not interfere with the pouring temperature and in order to obtain a high purity dielectric vegetable oil.

Finally, it is an objective of the present invention to provide an electric apparatus using a high purity dielectric vegetable oil, free of antioxidants and/or external additives having a content of from 17.7% to 28.5% in weight of mono-unsaturated fatty acid; from 49.8% to 57.1% in weight of di-unsaturated fatty acid; from 5.5% to 9.5% in weight of tri-unsaturated fatty acid and from 12.7% to 18.7% in weight of saturated fatty acid and having the following properties: a dielectric strength of from 50 kV to 80 KV (separation of 2 mm); a dielectric constant of less than 2.6 at 25° C. and a dissipation factor of from 0.05% to 0.2% at 25° C.

BRIEF DESCRIPTION OF THE DRAWINGS

The characteristics details of the invention are described in the following sections together with the accompanying drawings, which have the purpose of defining the invention but without reducing the scope thereof.

DETAILED DESCRIPTION OF THE INVENTION

In view of the necessity of having a high purity dielectric vegetable oil without any content of antioxidants and/or external additives which can be used in electric apparatuses as an isolating and cooling medium, applicant developed a method for obtaining a food grade high purity soy oil having good dielectric and biodegradation properties and which can be used electric transformers as an isolating fluid (dielectric), comprising optimizing the stages of bleaching and deodorization of the known Long-Mix Caustic Refinement process (RBD) used for producing oils for human consumption, using as raw material traditional crude soybean oil.

In the context of the present description, the term "free of antioxidants and/or/external additives" means that there is no content of any natural or synthetic compound capable of retarding, preventing or inhibiting the oxidation of another substance or compound in the crude vegetable original oil composition to be processed, nor are added during the refining of the crude vegetable oil nor are added or required to be added to the final composition of the high purity vegetable oil obtained in accordance with the present invention since said vegetable oil shows an excellent stability to oxidation as it is which makes it adequate to be used in electric apparatuses.

Generally, the method for obtaining a refined vegetable oil, which will be described in detail later, comprise the following stages: degumming which comprises the separation of hydratable phospholipids or gums using demineralized water, leaving only the no hydratable phospholipids; neutralization of the free fatty acids in the oil and removal of non hydratable phospholipids; neutralization of the free fatty acids in the oil and removal of the non hydratable phospholipids; bleaching, comprising the removal of chlorophylls, colored compounds and oxidation compounds in the oil as well as soap remains and metallic traces; and deodorization, which comprises the removal of volatile materials produced by the oil oxidation and thermic bleaching of the carotenes.

Figure 1:
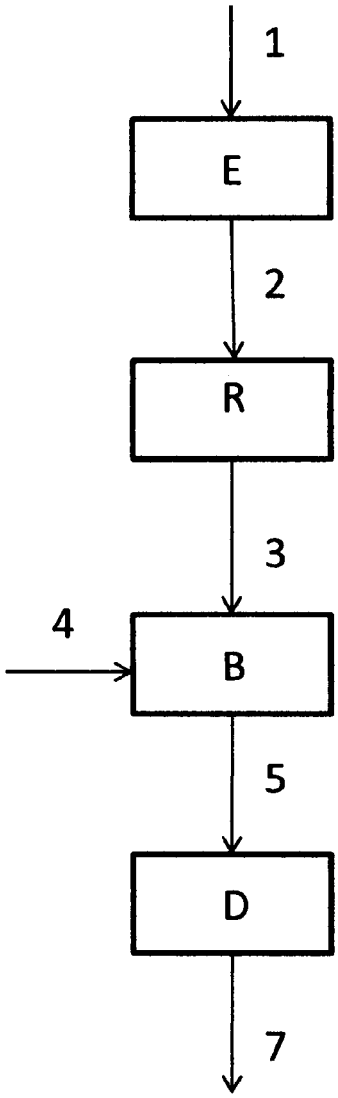
FIG. 1 show a block diagram of a Long-Mix Modified Caustic Refinement process (RBD) in accordance with the prior art. The method includes each one of its stages as well as their inputs and outputs.
Figure 2:
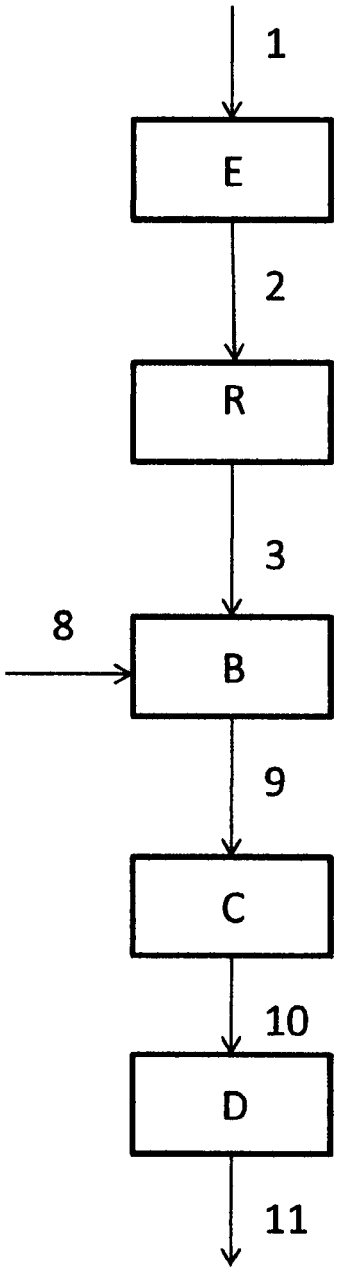
FIG. 2 show a block diagram of a process for obtaining a high purity dielectric vegetable oil without any content of antioxidants and/or external additives in accordance with the present invention. The method is shown based on a Long-Mix Modified Caustic Refinement process (RBD) including each one of its stages as well as their inputs and outputs in accordance with the present invention.

The method for obtaining a high purity dielectric vegetable oil with dielectric properties suitable to be used in electric apparatuses, for example, a transformer, as an insulator and cooling element of the present invention will now be described in detail, making reference to the Long-Mix Modified Caustic Refinement process (RBD) in accordance with the invention schematically represented in FIG. 2, which makes reference to the Long-Mix Caustic Refinement process (RBD) of the prior art schematically represented in FIG. 1 in order to distinguish both processes, using as raw material traditional crude soybean oil, wherein the Long-Mix Caustic Refinement process (RBD) comprising the stages of:

Degumming (E)

The first refining operation of the vegetable oils such as soy oil comprises the separation of the hydratable phospholipids by means of a treatment with demineralized water at 65° C., dispersing the water in the oil and allowing the dispersion to react during a time of approximately 20 minutes. Afterwards, by taking advantage of the different density between the heavy phase containing the phospholipids and the light phase containing the oil, both phases are separated by a centrifugal machine by which the non hydratable phospholipids are dissolved in the oil.

Entries to the degumming stage: demineralized water and raw vegetable soy oil 1.

Outputs from the degumming stage: degummed raw vegetable soy oil, lecitines (gums or phospholipids) and water 2.

Neutralization (R)

The first step of the Neutralization stage comprises the conversion of the non hydratable phospholipids to hydratable phospholipids in order to subsequently hydrate thereof and separate the hydrated phospholipids by taking advantage of their weight difference compared with the oil. The above referred reaction is carried out at a temperature of 35° C. with the addition of a phosphoric acid solution that is dispersed in the degummed raw vegetable soy oil by means of a high cutting force mixer, and wherein the reaction time is 60 minutes.

The neutralization of the free fatty acids is carried out by using a caustic soda in order to form soaps. Said first step is carried out at a temperature of 35° C. and a contact time of 20 minutes.

In order to react the solution of caustic soda (aqueous phase) with the free fatty acids to be neutralized which are dissolved in the degummed raw vegetable soy oil it is necessary to form an emulsion of small drops of aqueous solution in the oil by stirring using an oil/water high shear mixer. This provides an adequate contact area between the reagents so that a more selective reaction is achieved thus lowering the attack over the triglycerides (neutral oil) and avoiding the formation of di-glycerides and mono-glycerides that affect the oil dielectric properties due to the polarity of the molecules of said compounds.

The product of the above referred reaction (saponification reaction) comprises a soap which is separated from the degummed raw vegetable soy oil together with the phospholipids that were hydrated with the reagents solution water by means of the centrifugation of said mix at a temperature of 70° C.

Entries to the neutralization stage: degummed raw vegetable soy oil, lecitines (gums or phospholipids) 2, phosphoric acid solution, caustic soda solution 2a.

Outputs from the neutralization stage: soap, phospholipids, degummed and neutralized vegetable soya oil 3.

Bleaching (B)

The bleaching stage is carried out by contacting the oil with one or more adsorbents in a vacuum chamber. The percentage in weight of adsorbents that are mixed is proportional to the volume of oil to be treated. Said percentage in weight of adsorbent has to be added to the stream of oil being processed in the vacuum chamber at a temperature of between about 90 to 110° C. By a process of chemical adsorption the impurities such as soap, chlorophyll, and metallic traces are retained in the adsorbents and finally the adsorbents and impurities are separated by filtering the suspension.

The adsorption effect is considered to be a physical adsorption when the raise of concentration of impurities in the adsorbent is based in the Van Der Waals forces which are normally weak. On the other hand, the adsorption effect is considered to be a chemical adsorption when the adsorption depends on the chemical attraction forces between the solid surface and the solute surface by means of ionic or covalent bonds.

With respect to the bleaching of oils, it is considered that both adsorption mechanisms, physical and chemical adsorption act together. The chemical adsorption mechanism creates an uni-molecular layer in the available surface of the reagent and the Van Der Waals forces add additional molecular layers depending on the concentration of impurities in the oil.

Entries to the bleaching stage: degummed and neutralized vegetable soybean oil 3, adsorbents 4.

Outputs from the bleaching stage: used adsorbents, refined, neutralized and bleached vegetable soybean oil 5.

Deodorization (D)

In the deodorization stage, the compounds related to odors and tastes as well as some other colorant bodies are eliminated. The oil obtained in the deodorization stage comprises bland oil having no odor and a large shelf life if the oil is properly stored. The degummed, neutralized and bleached vegetable oil is filtered and preheated before being deaerated. The volume of the container where the deaereation is carried out is equivalent to the volume of each batch for allowing a semi continuous flow. At the same time the oil enters a deodorizer, the oxygen contacting the oil is eliminated by maintaining a very low pressure. Subsequently, the oil is distilled by stripping steam at an absolute pressure of from 2 to 3 mm of Hg and at 265° C. The volatile compounds at such conditions are removed from the oil further causing a thermal decomposition of the carotenes thus diminishing the red coloration of the refined, neutralized and bleached vegetable soy oil.

In this stage of the process, due to the high temperature at which the refined, neutralized and bleached vegetable soya oil must be treated, there is the risk of modifying the geometric configuration of the fatty acids double bonds by transforming them from its natural Cis configuration to a Trans configuration.

When the triglycerides fatty acids double bonds begin to form said fatty acids, their behavior begin to match the behavior of the saturated acids, i.e. raising their melting point which may cause an increase of the pouring temperature by starting the crystallization at a higher temperature compared with the crystallization temperature of an oil that is free of Trans fatty acids.

Subsequently, a filtering is carried out by using a 0.2 micron filter in order to segregate higher size particles, such as bleaching clay, polymers, etc., which act as oil oxidation promoters. At the same time the oil is stored.

Entries to the deodorization step: refined neutralized and bleached vegetable soy oil 5.

Outputs from the deodorization step: distilled fatty acids, refined, neutralized, bleached and deodorized vegetable soy oil 7, hereinafter called high purity vegetable soybean oil.

Based on the above referred description, an embodiment of the method of the present invention comprises carrying out the following modifications to the above referred process:

Submitting the refined, neutralized and filtered vegetable soybean oil (9) coming from the bleaching stage (B) to a second bleaching stage (C) in which the oil is heated to a temperature of between about 90 to 110° C., and subsequently contacting said oil with a bleaching earths in order to remove chlorophylls and oxidation products from the oil by chemical adsorption, which are retained thereof, thus obtaining a refined, neutralized and bleached vegetable soy oil (10).

The second bleaching step is carried out in batch mode and each batch comprises the oil of a filtering step. The second stage ends when the impurities content in the degummed, neutralized and bleached vegetable soya oil are in accordance with the values shown in Table 1 which is tested using the official methods of the American Oil Chemists' Society (AOCS).

TABLE 1

| Impurity | Containment | Method AOCS |
|---|---|---|
| Free fatty acids | <0.05% by weight | Ca 5a-40 |
| Soap | 0 ppm | Cd 17-95 |
| Phosphorus | <3 ppm | Ca 20-99 |
| Calcium | <1 ppm | Ca 20-99 |
| Magnesium | <1 ppm | Ca 20-99 |
| Chlorophyll "a" | 5 ppb | Cc 13d-55 |

This impurity containment warranties that the oil has suitable dielectric properties to be used in electric apparatuses as isolating element and cooling media.

After the, neutralized and bleached refined soya vegetable oil (10) is subjected to the deodorizing step (D), wherein the distillation temperature with stripping steam adjusted at a maximum of 265° C. for 20 minutes maximum in order that the production of Trans-fatty acids do not interfere with the pouring temperature.

Thanks to the second bleaching step to which the oil is additionally subjected, at the starting of the cycle it is obtained an oil having a level of impurities equivalent to having used a very high percentage of adsorbent material, and as the time goes by, the impurities deposited on the adsorbent material will reduce its capacity to remove impurities, until reaching its minimum adsorbent capacity within the established parameters. The relative amount of the absorbent material, compared with the quantity of impurities to be removed, is greater than in the typical method that includes a single bleaching step, which allows to remove a higher percentage of impurities at the starting of the cycle, than in the typical method wherein the oil stream is only mixed with a proportional amount of absorbent material in order to subsequently separate the solids with assimilated impurities by filtration.

The absorbent used in the bleaching steps has an amount of oil in the order of 30% to 40% which causes an additional cost. Therefore, if it is desired to increase the removing level in the typical method, the amount of absorbent should be increased, so that an increase in the cost of the absorbent used and the amount of retained oil will be incurred, so as to obtain oil with the desired dielectric characteristics.

Last but not least, after the deodorizing step (D) a vegetable soy oil of high purity with dielectric properties (11) is obtained, including the amount of impurities shown on Table 2 and identified with the methods from the AOCS:

TABLE 2

| Impurity | Containment | Method AOCS |
|---|---|---|
| Free fatty acids | <0.03% by weight | Ca 5a-40 |
| Soap | 0 ppm | Cd 17-95 |
| Phosphorus | <3 ppm | Ca 20-99 |
| Calcium | <1 ppm | Ca 20-99 |
| Magnesium | <1 ppm | Ca 20-99 |
| Cooper | <1 ppm | Ca 20-99 |
| Iron | <1 ppm | Ca 20-99 |
| Sodium | <1 ppm | Ca 20-99 |
| Moisture | <200 ppm | Ca 2c-25 |
| Chlorophyll "a" | 5 ppb | Cc 13d-55 |
| Polar Component | <1.0% by weight | Cd 20-91 |
| Peroxide Value | 0.0 meq/kg | Cd 8-53 |
| Anisidine value | <1.5 meq/kg | Cd 18-90 |
| Conjugated Dienes | <0.4% by weight | Ti 1a-64 |
| Refraction index | from 1.466 a 1.488 | Cc 7-25 |

In the same way, the composition in terms of fatty acid components of the dielectric high purity vegetable oil, free from antioxidants and/or external additives obtained in accordance with the present invention, is as follows:

from 17.7% to 28.5% of oleic acid;
from 49.8% to 57.1% of linoleic acid;
from 5.5% to 9.5% of linolenic acid;
from 9.7% to 13.3% of palmitic acid; and
from 3.0% to 5.4% of stearic acid.

These components of fatty acid, comprising of carbon chains vary between 16 to 22 carbon atoms. If the carbon chain does not have double links, it is saturated and it is designed asCn:0; the chains with a double links are monounsaturated and are designated Cn:1; with two double links are di-unsaturated and are designated Cn:2; and with three double links are tri-unsaturated and are designated Cn:3; wherein "n" is the number of carbon atoms. Based on the former, the oleic acid is a monounsaturated fatty acid C18:1, the linoleic acid is a di-unsaturated acid C18:2, the linolenic acid is tri-unsaturated fatty acid C18:3, the palmitic acid saturated fatty acid C16:0 and the estearic acid is a saturated fatty acid C18:0.

On the other hand, the dielectric high purity vegetable oil, free from antioxidants and/or external additives obtained in accordance with the present invention has specific physical properties shown in Table 3, which have been determined mostly by testing methods from the American Society for the Testing of Materials known by its initials as ASTM. These specific physical properties make the oil from this invention especially suitable for use as a dielectric and refrigerant fluid of electric apparatuses.

TABLE 3

| Specific physical property | Measurement | Test method |
|---|---|---|
| Dielectric strength | from 50 kV to 80 kV, preferably from 50 kV to 60 kV (separation of 2 mm) | ASTM D 1816 |
| Dielectric constant | menor a 2.6 a 25° C. | ASTM D 924 |
| Dissipation factor | from 0.05% to 0.2%, preferably from 0.08% to 0.15% at 25° C. | ASTM D 924 |
| Pouring Point | −21° C. to −10° C., preferably from −15° C. to −10° C. | ASTM D 97 |
| Kinematic viscosity | Less than 35 cST at 40° C. and less that 7 cST at 100° C. | Viscosimeter (reometer Haake RS150) |
| Flammable Temperature | at least 330° C. | ASTM D 92 |
| Ignition Temperature | at least 350° C. | ASTM D 92 |
| Acid number | from 0.02 mg to 0.06 mg | ASTM D 974 |

TABLE 3-continued

| Specific physical property | Measurement | Test method |
|---|---|---|
| | KOH/g | |

The dielectric vegetable oil composition of the present invention is free from antioxidants and or external compounds; however it presents characteristics of stability to oxidation suitable for its application as isolating and cooling fluid. Laboratory test shown that the dielectric vegetable oil of the present invention exhibits values of stability to oxidation similar to those of the vegetable oil commercially used nowadays in electric transformers and that use synthetic additives in their composition to improve its oxidative stability. The test were developed following the procedures of the norm ASTM 2440 and the results are shown in Table 4

TABLE 4

| | Dielectric vegetable oil of the present invention (high purity soy oil without antioxidants nor additives | Dielectric vegetable oil of commercial use (soy oil + antioxidants and synthetic additives) |
|---|---|---|
| Percentage of sludge generation at 72 hours | 70 to 80% | 79% |

Both dielectric vegetable oils exhibit similar characteristics regarding the stability to oxidation, even when the vegetable oil of the present invention is free from antioxidants and/or external compounds either natural or synthetic. The oxidative characteristics of the dielectric vegetable oil of the present invention are obtained by means of modifications to the elaboration process of the oil, by difference from the commercial vegetable oils that actually are used in the electric transformers.

The composition of the dielectric, high purity and free from antioxidants and/or external additives vegetable oil disclosed in the present invention fulfills with the current specifications and requirements for the dielectric fluids of the vegetable type, by which it is feasible its application in electric apparatuses, including electric transformers, condensers or transmission cables. At difference from the current dielectric vegetable oils, to which there are incorporated synthetic compounds, this invention presents a composition free from antioxidants and/or external additives either natural or synthetic or mixtures thereof in its formulation, obtaining the final characteristics by means of an innovation to the process RBD. The result is dielectric vegetable oil completely natural, highly biodegradable and low flammable, characteristics that allow to reduce at maximum a negative impact to the environment by possible accidents that spills the fluid, generation of toxic wastes and fire risks.

It should be understand that the dielectric high purity and free form antioxidants and/or external additives vegetable oil and the method for obtaining them, of the present invention, are not limited to the formerly disclosed embodiment and that the experts in the field will be able, by the teaching established hereby, to carry out changes in the high purity vegetable oil having dielectric properties and free from antioxidants and/or external additives and on the method of obtaining them, of the present invention, whose scope shall be established exclusively by the following claims:

The invention claimed is:

1. An electric apparatus comprising a dielectric fluid, the dielectric fluid being free of synthetic additives and comprising a high purity vegetable oil, comprising:

from 17.7% to 28.5% by weight of a mono-unsaturated fatty acid;

from 49.8% to 57.1% by weight of a di-unsaturated fatty acid;

from 5.5% to 9.5% by weight of a tri-unsaturated fatty acid; and from 12.7% to 18.7% by weight of a saturated fatty acid.

2. The electric apparatus of claim 1, wherein the high purity vegetable oil is soybean oil.

3. The electric apparatus of claim 1, wherein the high purity vegetable oil has a dielectric strength of from 50 kV to 60 kV at separation of 2 mm.

4. The electric apparatus of claim 1, wherein the high purity vegetable oil has a dissipation factor of 0.08% to 0.15% at 25° C.

5. The electric apparatus of claim 1, wherein the high purity vegetable oil has:

a pouring point of −21° C. to −10° C.;

a kinematic viscosity less than 35 cST a 40° C. and less to 7 cST at 100° C.;

0.0 meq/kg of peroxide index;

a flammable temperature of at least 330° C.;

an ignition temperature of at least 350° C.; and an acid number of 0.02 to 0.06 mg KOH/g.

6. The electric apparatus of claim 1, wherein the high purity vegetable oil has:

less than 0.03% by weight of free fatty acids;

0 ppm of soap;

less than 8 ppm of phosphorus, calcium, magnesium, copper, iron, and sodium;

less than 5 ppb of chlorophyll "a"; and less than 200 ppm of moisture.

7. The electric apparatus of claim 6, wherein the high purity vegetable oil has:

less than 3 ppm of phosphorus;

less than 1 ppm of calcium;

less than 1 ppm of magnesium;

less than 1 ppm of copper;

less than 1 ppm of iron; and less than 1 ppm of sodium.

8. The electric apparatus of claim 1, wherein the high purity vegetable oil has a stability to oxidation with sludge generation between 70% to 80% as determined by ASTM D 2440.

9. The electric apparatus of claim 1, wherein the high purity vegetable oil has:

0.0 meq/kg of peroxide value;

less than 1% by weight of polar components; and less than 0.4% by weight of conjugated dienes.

10. The electric apparatus of claim 1, wherein the high purity vegetable oil has a refraction index of 1.466 to 1.488.

11. The electric apparatus of claim 1, wherein the high purity vegetable oil comprises:

from 17.7% to 28.5% by weight of oleic acid;

from 49.8% to 57.1% by weight of linoleic acid;

from 5.5% to 9.5% by weight of linolenic acid;

from 9.7% to 13.3% by weight of palmitic acid; and from 3.0% to 5.4% by weight of stearic acid.

12. The electric apparatus of claim 1, wherein the high purity vegetable oil has:

a dielectric strength of 50 kV to 80 kV at a separation of 2 mm;

a dielectric constant of less than 2.6 at 25° C.; and a dissipation factor of 0.05% to 0.2% at 25° C.

13. An electric apparatus comprising a dielectric fluid consisting essentially of a high purity vegetable oil, the high purity vegetable oil consisting essentially of:

from 17.7% to 28.5% by weight of a mono-unsaturated fatty acid;

from 49.8% to 57.1% by weight of a di-unsaturated fatty acid;

from 5.5% to 9.5% by weight of a tri-unsaturated fatty acid; and from 12.7% to 18.7% by weight of a saturated fatty acid.

14. The electric apparatus of claim 13, wherein the oil has:

a dielectric strength of 50 kV to 80 kV at a separation of 2 mm;

a dielectric constant of less than 2.6 at 25° C.; and a dissipation factor of 0.05% to 0.2% at 25° C.

15. The electric apparatus of claim 13, wherein the oil is soybean oil.

16. The electric apparatus of claim 13, wherein the oil has a dielectric strength of from 50 kV to 60 kV at a separation of 2 mm.

17. The electric apparatus of claim 13, wherein the oil has a dissipation factor of from 0.08% to 0.15% at 25° C.

18. The electric apparatus of claim 13, wherein the oil has:

a pouring point of −21° C. to −10° C.;

a kinematic viscosity less than 35 cST a 40° C. and less to 7 cST at 100° C.;

a flammable temperature of at least 330° C.;

an ignition temperature of at least 350° C.; and an acidity number of 0.02 to 0.06 mg KOH/g.

19. The electric apparatus of claim 13, wherein the oil has a pouring point of −15° C. to −10° C.

20. The electric apparatus of claim 13 wherein the oil has:

less than 0.03% by weight of free fatty acids;

0 ppm of soap;

less than 8 ppm of phosphorus, calcium, magnesium, copper, iron, and sodium;

less than 5 ppb of chlorophyll "a"; and less than 200 ppm of moisture.

21. The electric apparatus of claim 20, wherein the oil has:

less than 3 ppm of phosphorus;

less than 1 ppm of calcium;

less than 1 ppm of magnesium;

less than 1 ppm of copper;

less than 1 ppm of iron; and less than 1 ppm of sodium.

22. The electric apparatus of claim 13, wherein the oil has a stability to oxidation with sludge generation between 70 to 80% as determined by ASTM D 2440.

23. The electric apparatus of claim 13, wherein the oil has:

0.0 meq/kg of peroxide value;

less than 1% by weight of polar components; and less than 0.4% by weight of conjugated dienes.

24. The electric apparatus of claim 13, wherein the oil has a refraction index of 1.466 to 1.488.

25. The electric apparatus of claim 13, wherein the oil consists essentially of:

from 17.7% to 28.5% by weight of oleic acid;

from 49.8% to 57.1% by weight of linoleic acid;

from 5.5% to 9.5% by weight of linolenic acid;

from 9.7% to 13.3% by weight of palmitic acid; and from 3.0% to 5.4% by weight of stearic acid.

* * * * *

UNITED STATES PATENT AND TRADEMARK OFFICE

CERTIFICATE OF CORRECTION

PATENT NO. : 8,808,585 B2
APPLICATION NO. : 13/298004
DATED : August 19, 2014
INVENTOR(S) : Alberto Jose Pulido Sanchez et al.

It is certified that error appears in the above-identified patent and that said Letters Patent is hereby corrected as shown below:

Title Page 2 in the column OTHER PUBLICATIONS, line 46 go to "I. Moumine, et al.", beside the word "International":
Delete: "Conferernce"
Insert: --Conference--

Title Page 2 in the column OTHER PUBLICATIONS, line 67 go to "J.H. Torrai, et al.", beside the words "Restoration of Dielectric":
Delete: "Propertiies"
Insert: --Properties--

In the Specification

Column 6, Line 37:
Delete: "deaereation"
Insert: --deaeration--

Column 8, Table 2, Line 9:
Delete: "Cooper"
Insert: --Copper--

Column 8, Line 29:
Delete: "asCN:0;"
Insert: --as CN:0;--

Column 8, Table 3, Line 61:
Delete: "reometer"
Insert: --rheometer--

Signed and Sealed this
Twenty-fifth Day of November, 2014

Michelle K. Lee

Michelle K. Lee
*Deputy Director of the United States Patent and Trademark Office*

Column 9, Line 8:
Delete: “and or”
Insert: --and/or--

Column 9, Line 18 after “Table 4”:
Insert: --.--

In the Claims

Column 10, Claim 5, Line 23 after “cST”:
Delete: “a”
Insert: --at--

Column 11, Claim 18, Line 25 after “cST”:
Delete: “a”
Insert: --at--